US006554962B2

(12) United States Patent
Uryu et al.

(10) Patent No.: US 6,554,962 B2
(45) Date of Patent: Apr. 29, 2003

(54) LOUDSPEAKER DIAPHRAGM

(75) Inventors: Masaru Uryu, Chiba (JP); Kunihiko Tokura, Saitama (JP); Yoshio Ohashi, Kanagawa (JP); Satoshi Idemura, Chiba (JP); Michiya Nakashima, Chiba (JP); Katsuji Takahashi, Chiba (JP)

(73) Assignees: Sony Corporation, Tokyo (JP); Dai Nippon Ink and Chemicals, Inc., Tokyo (JP)

( * ) Notice: Subject to any disclaimer, the term of this patent is extended or adjusted under 35 U.S.C. 154(b) by 54 days.

(21) Appl. No.: 09/834,400

(22) Filed: Apr. 13, 2001

(65) Prior Publication Data

US 2002/0096298 A1 Jul. 25, 2002

(30) Foreign Application Priority Data

Apr. 13, 2000 (JP) ..... 2000-117218

(51) Int. Cl.[7] ..... H04R 9/06; D21J 1/00

(52) U.S. Cl. ..... 162/218; 162/156; 162/157.3; 181/167; 181/169; 381/426; 381/428

(58) Field of Search ..... 162/156, 223, 162/218, 157.3; 264/24, 49, 108, 143; 524/606, 492, 493, 494, 608; 181/167, 469; 381/426, 428

(56) References Cited

U.S. PATENT DOCUMENTS 4,177,228 A * 12/1979 Prolss ..... 264/24
6,063,862 A 5/2000 Idemura et al. ..... 524/606
6,188,774 B1 * 2/2001 Sabato et al. ..... 381/424

FOREIGN PATENT DOCUMENTS

JP 55 107396 * 8/1980
JP 57 113695 * 7/1982
JP 026613 A * 1/2000

* cited by examiner

*Primary Examiner*—Dean T. Nguyen
(74) *Attorney, Agent, or Firm*—Sonnenschein, Nath & Rosenthal

(57) ABSTRACT

A loudspeaker in which the input resistance is improved and the effect of humidity on the playback frequency response is suppressed, and a method for the preparation of the loudspeaker. A sheet-like product, containing glass particles with a particle size of 8 nm to 300 nm and polyamide resin, and prepared by application of a paper-making technique, is used as the diaphragm. The content of the glass particles in the compound material is 5 weight % to 70 weight %. In preparing the diaphragm, a phase of an aqueous solution containing diamine and water glass is contacted with a phase of an organic solution containing a dicarboxylic acid halide to generate a compound material containing glass particles and the polyamide resin. The compound material so prepared is formed into a sheet by a paper-making technique. In the process of the preparation by the paper-making technique, the compound material mixed with other fibrous material may also be used as a starting material.

8 Claims, 2 Drawing Sheets

LOUDSPEAKER DIAPHRAGM

RELATED APPLICATION DATA

The present invention claims priority to Japanese Application No. P2000-117218 filed Apr. 13, 2000, which application is incorporated herein by reference to the extent permitted by law.

BACKGROUND OF THE INVENTION

1. Field of the Invention

This invention relates to a novel loudspeaker employing a compound material of a polyamide resin and glass particles for a diaphragm, and a method for the preparation thereof.

2. Description of Related Art

Recently, as the acoustic equipment, such as audio amplifier, is improved in performance, large level signals (large input) are liable to be applied to the loudspeaker, so that a demand is raised for improving its input resistance.

If a large input is applied to a loudspeaker, there is evolved heat in a voice coil section driving the diaphragm, thus thermally damaging the diaphragm. For example, polypropylene, so far used perferentially as a diaphragm material, has a thermal deformation temperature as low as approximately 100° C. (ASTM D648: 0.455 MPa), and hence a problem is raised that the diaphragm made of polypropylene is deformed by the large input, thus possibly destructing the loudspeaker.

By way of a countermeasure therefor, there is proposed a diaphragm for a loudspeaker employing a polyimide based resin, as a highly heat-resistant material, a liquid crystal polymer, or a heat-resistant resin, such as polyetherketone resin.

However, the high thermal resistance indicates forming difficulties, thus possibly leading to the lowering of productivity and to the increased manufacturing cost. Moreover, the material itself is expensive, thus leading to increased overall cost.

For resolving the above problem, such a diaphragm is proposed which employs a polyamide resin having a higher thermal deformation temperature of approximately 190° C., or a compound material formed of the polyamide resin admixed with inorganic fillers, such as glass fibers, carbon fibers, mica powders or calcium carbonate.

In these materials, the heat-related problems are resolved. However, there is presented such a problem that, due to significant changes in the modulus of elasticity caused by hygroscopicity proper to the amide resin, the playback frequency response of the loudspeaker employing these materials for the diaphragm is changed significantly between that in the dry state and that in the humid state.

SUMMARY OF THE INVENTION

It is therefore an object of the present invention to provide a loudspeaker having superior input resistance properties and superior moisture-proofness and which is not prone to destruction even under a large input such that the replay frequency response is not affected by humidity.

The present inventors have conducted eager researches, and found that the above object can be accomplished by using a homogeneous composite consisting of microscopic glass particles and a polyamide type resin, obtained by polyamide synthesis in the presence of water glass, as an acoustic diaphragm. This finding has led to completion of the present invention.

In one aspect, the present invention provides a diaphragm for a loudspeaker including a compound material containing glass particles having a particle size of 8 to 300 nm and a polyamide resin, in which the compound material is a sheet-like member formed by a paper-making technique.

In another aspect, the present invention provides a method for the preparation of a diaphragm for a loudspeaker including contacting a phase of an aqueous solution containing a diamine and water glass and a phase of an organic solution containing a dicarboxylic acid halide to generate a compound material containing glass particles and a polyamide resin, and forming the resulting compound material to the shape of a diaphragm by application of a paper-making technique.

The polyamide resin has a higher thermal deformation temperature and satisfactory castability. However, if used alone, the polyamide resin undergoes marked change in the modulus of elasticity due to its hygroscopicity.

On the other hand, with a glass/polyamide compound material, in which extremely fine glass particles are homogeneously dispersed in the polyamide, these changes in the modulus of elasticity caused by moisture absorption may be eliminated to assure high thermal resistance and only slight lowering of the physical properties ascribable to moisture absorption.

Therefore, in a speaker employing this compound material as a diaphragm, the input resistance is improved, while the reproducing frequency response is not affected by humidity.

Moreover, in the compound material obtained on contacting the aqueous solution containing the diamine and water glass and the organic solution containing the dicarboxylic acid halide, the glass particles are homogeneously dispersed in the fibrous polyamide resin, such that it can be readily formed to the shape of a diaphragm by the customary paper-making method.

That is, according to the present invention, employing a sheet-like material, mainly composed of a compound material composed of extremely fine glass particles are homogeneously dispersed in the polyamide, as a diaphragm, the input resistance and the moisture-proofness can be improved appreciably.

DESCRIPTION OF THE PREFERRED EMBODIMENTS

Figure 1:
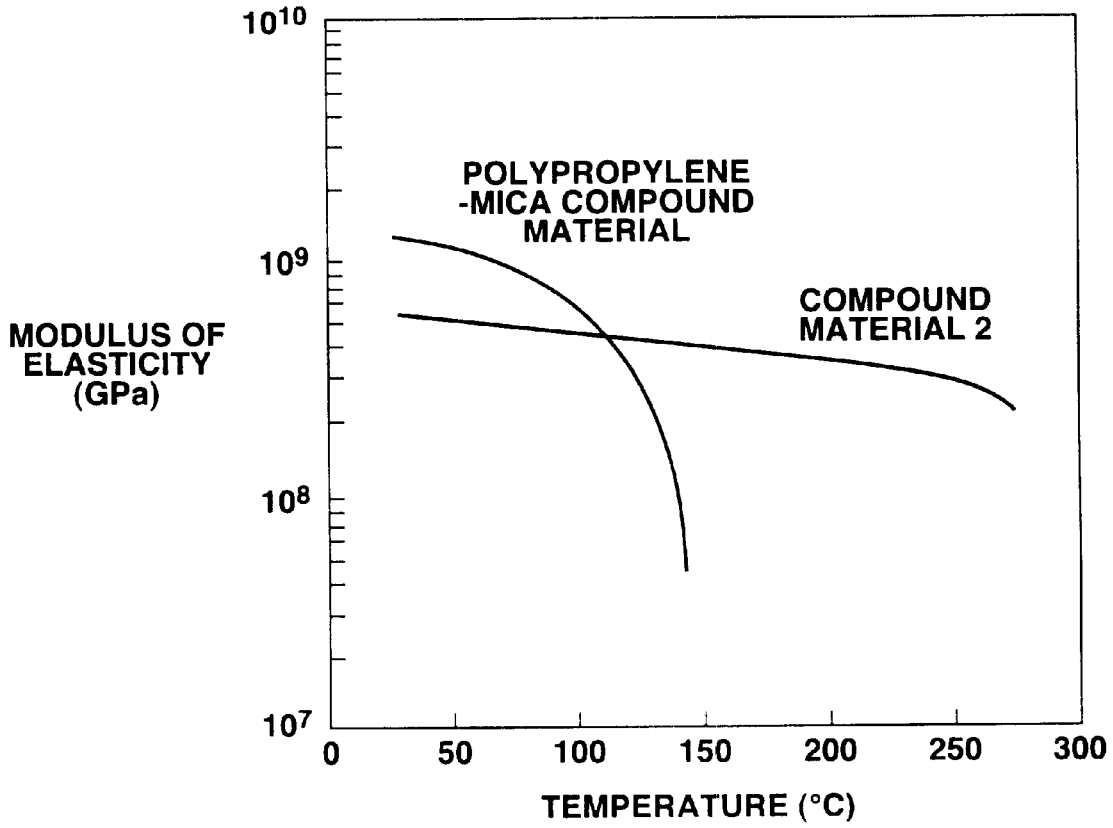
FIG. 1 is a graph showing temperature characteristics of the modulus of elasticity of a glass/polyamide compound material and a polypropylene/mica compound material.

Referring to the drawings, a loudspeaker and a method for the preparation thereof, according to the present invention, will be explained in detail.

The loudspeaker of the present invention employs a polyamide resin, containing glass particles, referred to below as a glass/polyamide compound material, is used as a material for the diaphragm, and a sheet thereof prepared by the paper-making technique is used as a diaphragm.

The glass particles contained in this glass/polyamide compound material are of extremely small size, with the particle size being 8 to 300 nm. If the particle size of the glass particles is coarse-sized, being larger than 300 nm, the effect in improving moisture-proofness falls short, while adhesion to the polyamide resin also falls short, thus presenting a problem of exfoliation.

The content of the glass particles in the above-mentioned glass/polyamide compound material is preferably 5 weight % to 7 weight %. If the content of the glass particles is less than 5 weight %, the meritorious effect of adding the glass particles, such as moisture-proof property, is in shortage. If conversely the content of the glass particles exceeds 70 weight %, the physical properties of the glass become dominant, such that the problem of brittleness is presented when the compound material is used as a diaphragm. Moreover, if the content of the glass particles is excessive, the inter-fiber interaction of the glass/polyamide compound material is lowered such that physical properties tend to be lowered when the compound material is formed to a sheet by the paper-making technique.

The glass/polyamide compound material is obtained as a fibrous product, which may be formed into a sheet by a paper-making technique in the same way as in forming the fibrid to produce a diaphragm of the desired shape.

In this case, the glass/polyamide compound material may be used singly and formed into a sheet by the paper-making technique. Alternatively, the glass/polyamide compound material may be mixed with other fibers, such as fibrid, by the paper-making technique, to form a sheet.

In the latter case, the proportion of the glass/polyamide compound material is preferably 5 weight % or more. If the proportion of the glass/polyamide compound material is less than 5 weight %, this characteristic cannot be exploited sufficiently.

The glass/polyamide compound material, used as the diaphragm material in the present invention, is suited as a diaphragm since it has such characteristics that (1) the matrix resin is a polyamide resin and hence has high thermal resistance;

(2) the lowering of the modulus of elasticity is small because of the presence of ultra-fine glass particles of 8 to 300 nm in particle size compounded therein;

(3) since the glass/polyamide compound material is fibrous in nature, the paper-making technique, used extensively in the manufacturing process for a paper diaphragm, can be applied; and that (4) the glass/polyamide compound material can be formed into a sheet with a variety of fibrous materials such that it is possible to adjust physical properties, such as modulus of elasticity, required in the designing of a loudspeaker.

Since the glass/polyamide compound material has high thermal resistance and suffers from only limited lowering of physical properties caused by moisture absorption, input resistance can be improved appreciably by employing this compound material as the loudspeaker. Moreover, reproducing frequency characteristics can be prevented from being affected by humidity, thus significantly improving moisture-proof property.

The manufacturing method for the loudspeaker and in particular that for the diaphragm are hereinafter explained.

For preparing a diaphragm used for a loudspeaker of the present invention, it is necessary to synthesize the aforementioned glass/polyamide compound material.

For producing the glass/polyamide compound material comprising glass particles homogeneously dispersed in the polyamide resin, it is sufficient if water glass is caused to co-exist in the phase of the aqueous solution by a so-called interfacial polycondensation reaction in which monomers are reacted on the interface of a phase of an aqueous solution and a phase of an organic solution.

Specifically, a solution of an aqueous solution composed essentially of a diamine and water glass (solution A) and a phase of an organic solution composed essentially of a dicarboxylic acid halide and an organic solvent (solution B) are contacted to produce a glass/polyamide compound material in a fibrous morphology such as fibrid form.

Among diamine monomers contained in the solution A, there are diamines having aliphatic chains, such as 1,3-diaminopropane, 1,4-diaminobutane, 1,5-diaminopentane, 1,6-diaminohexane, m-xylylenediamine or p-xylylenediamine, alicyclic diamines, such as 2,5-norbornanediamine or 2,6-norbornane diamine, m-phenylenediamine, p-phenylene diamine, 1,5-diaminonaphthalene, 1,8-diaminonaphthalene, 2,3-diaminonaphthalene, 3,4-diaminodiphenylether, 4,4-diaminodiphenylether, 3,4-diaminodiphenylsulfone, 4,4-diaminodiphenylsulfone, 3,4-diaminodiphenylmethane and 4,4-diaminodiphenylmethane and a totality of aromatic diamines obtained on substituting halogens, nitro groups or alkyl groups for one or more hydrogens of aromatic rings of the above compounds. Of these, 1,6-diaminohexane, m-xylylenediamine and m-phenylenediamine are preferred.

The water glass contained in the solution A is a water-soluble glass having a chemical composition represented by $M_2O.nSiO_2$, where M is an alkali metal. For example, water glass previously dissolved in water, such as water glass Nos. 1, 2, 3 and 4, stated for example in JIS (Japanese Industrial Standard) K1408-1950, in which M denotes sodium, with $1.2 \leqq n \leqq 4$, may be used.

The concentration of water glass may be in a range from 2 to 100 g/liter based on a solid content. The glass content in the compound material may be controlled by adjusting the concentration of water glass.

For sufficiently promoting the polycondensation reaction, acid receptors, such as sodium hydroxide, or surfactants, such as sodium lauryl sulfate, may be added as necessary.

Among organic solvents contained in the solution B, toluene, xylene, methyl isobutyl ketone, chloroform, cyclohexane, cyclohexanone or tetrahydrofuran, may be stated as being representative. Among the dicarboxylic acid halides, as monomers reacted with diamine monomers, adipoyl chloride, azelaoyl chloride, terephthaloyl chloride or isophthaloyl chloride, may be stated as being representative.

In the glass/polyamide compound material used in the present invention, the reaction of the water glass itself proceeds with the introduction of the water glass to the polyamide as a result of contact between the solutions A and B, so that the glass is introduced homogeneously into the polyamide as being high-quality silica type glass with only small quantity of the alkali metal components.

The contact between the solutions A and B herein means both the interfacial contact of the two without mixing and the contact with mixing.

The glass contained in the glass/polyamide compound material thus synthesized has a particle size as small as 8 to 300 nm and exhibits optimum adhesion. The glass content in the compound material may be controlled by adjusting the concentration of the monomers or the water glass.

By setting the monomer concentration in the solutions A and B to 0.1 to 1.2 mol/liter, the glass/polyamide compound material can be produced as a fibrous material with optimum amenability to a paper-making type manufacturing process.

If a particulate compound material exhibiting no amenability to a paper-making type manufacturing process is produced, a fibrous material exhibiting amenability to a paper-making type manufacturing process can be obtained by co-precipitating the compound material and the pure polyamide from a good solvent therefor.

The fibrous glass/polyamide compound material, thus obtained, may directly be used for the paper-making like manufacturing method, as a technique for producing the paper diaphragm, such that, similarly to the routine paper diaphragm, a diaphragm of a desired shape can be formed by the paper-making like manufacturing process.

It is possible to use only the glass/polyamide compound material for the paper-making like producing process, or this glass/polyamide compound material may be mixed with other fibers, such as pulp, as a starting material for the paper-making like producing process.

EXAMPLE

The present invention is now explained with reference to specified Examples, based on experimental results.

Synthesis of Glass/Polyamide Compound Material

To 27 g of water glass and 4.64 g of 1,6-diaminohexane was added distilled water at room temperature and the resulting mixture was agitated to prepare 300 ml of a homogeneous transparent aqueous solution.

To 7.32 g of adipoyl chloride was added toluene and the resulting mixture was agitated to prepare 200 ml of a homogeneous transparent organic solution.

The above aqueous solution was charged into a 1-liter capacity blender vessel, manufactured by OSTERIZER INC. The above organic solution was added to the aqueous solution in the blender vessel at 25° C., at a time, as the aqueous solution in the blender vessel was agitated at an rpm of 10000 with an annexed agitation blade.

From the mixed solution was immediately precipitated a compound material in the form of white-colored fibrid. The agitation was continued for two minutes as the state of suspension was maintained.

After filtration, the precipitated fibrid were washed with boiling acetone and then with distilled water to produce fibrid of the glass/polyamide compound material.

The glass content was approximately 50 weight %, with the particle size of the glass particles contained in the compound material being 8 to 300 nm.

Similarly, a glass/polyamide compound material having the glass content of approximately 5 weight %, a glass/polyamide compound material having the glass content of approximately 50 weight % and a glass/polyamide compound material having the glass content of approximately 70 weight % were produced in the above reaction system. In the following, these three sorts of the compound materials were used.

In the following, the glass/polyamide compound materials with the amounts of the glass of 5 weight %, 50 weight % and 70 weight % are termed compound materials 1, 2 and 3, respectively.

Evaluation of Characteristics of Compound Materials

The compound material 2 produced was dispersed in water and formed by a paper-making technique into a sheet with a weight of 80 g/m$^2$. Using a dynamic viscoelasticity measurement unit (RHEOVIBRON manufactured by ORIENTEC INC.), evaluation was made of temperature dependence of physical properties of the compound material 2.

For comparison sake, similar measurements were made of a polypropylene/mica compound material (proportion of mica: 30 weight %) preferentially used for a loudspeaker diaphragm.

The results are shown in FIG. 1.

As may be seen from FIG. 1, the polypropylene/mica compound material is significantly lowered in modulus of elasticity at a temperature 130° C. or higher, whereas the glass/polyamide compound material 2 undergoes only limited lowering of the modulus of elasticity at 250° C. or higher, thus testifying to the high thermal resistance of the glass/polyamide compound material 2.

From each of the three compound materials (compound materials 1 to 3), a sheet was similarly prepared by a paper-making technique and allowed to stand for 24 hours in an atmosphere of 25° C. temperature and 95% relative humidity to cause approximately 5 weight % of the moisture to be absorbed into the sheet. The modulus of elasticity was measured by a vibration reed method to compare the modulus of elasticity before and following the moisture absorption.

For comparison, fibrid composed only of a polyamide component were synthesized, and similar measurements were made of the sheets prepared therefrom.

The results are shown in Table 1:

TABLE 1

| | compound material 1 | compound material 2 | compound material 3 | only polyamide component |
|---|---|---|---|---|
| modulus of elasticity before moisture absorption GPa) | 0.47 | 0.61 | 0.63 | 0.41 |
| modulus of elasticity after moisture absorption (GPa) | 0.40 | 0.58 | 0.62 | 0.21 |
| rate of change (%) | 14.8 | 5.7 | 0 | 48.0 |

In the sheet formed only of a polyamide component, the physical properties are lowered appreciably. In the compound materials 1 to 3, the lowering of the physical properties as the result of moisture absorption is decreased, thus indicating marked improvement in moisture-proof property.

Preparation of the Loudspeaker

A loudspeaker cone was prepared by preparing a sheet of the compound material 2 by a paper-making technique. Using a voice coil, a voice coil bobbin of which is formed by an aluminum foil, a full-range speaker, 16 cm in diameter, was prepared as Example 1.

Similarly, a loudspeaker cone as a diaphragm was prepared from a polypropylene/mica compound material to prepare a full-range loudspeaker 16 cm in diameter as Comparative Example 1.

The loudspeakers, prepared as described above, were put to an input resistance test based on EIJA testing standard. The testing time was set to 100 hours.

The results are shown in Table 2.

TABLE 2

| | Example 1 | | | Comparative Example 1 | | |
|---|---|---|---|---|---|---|
| input (W) | 40 | 60 | 80 | 40 | 60 | 80 |
| time until breakdown (hrs) | 100 | 100 | 100 | 100 | 33 | 12 |

In the Comparative Example 1, heat evolved in the voice coil from an aluminum foil as a voice coil bobbin component is transmitted to the diaphragm so that the diaphragm was thermally deformed at inputs of 60 and 80 W before the test time duration of 100 hours elapses such that the diaphragm/voice coil bonding point was destroyed.

Conversely, the loudspeaker, employing the compound material 2 as a diaphragm, remained thermally stable, without being destroyed, thus testifying to the high input resistance.

A loudspeaker cone as a diaphragm was then prepared from the glass/polyamide compound material 2. Using this loudspeaker cone, a 5 cm full-range loudspeaker was prepared (Example 2) and allowed to stand in an atmosphere of the temperature of 25° C. and the relative humidity of 95%. The frequency response before storage and that after storage were measured and compared to each other to check for the effect of temperature.

For comparison, a loudspeaker cone as a diaphragm was prepared from a material composed only of the polyamide component and a similar loudspeaker was prepared (Comparative Example 2). The frequency response before storage and that after storage were similarly measured and compared to each other to check for the effect of temperature.

Figure 2:
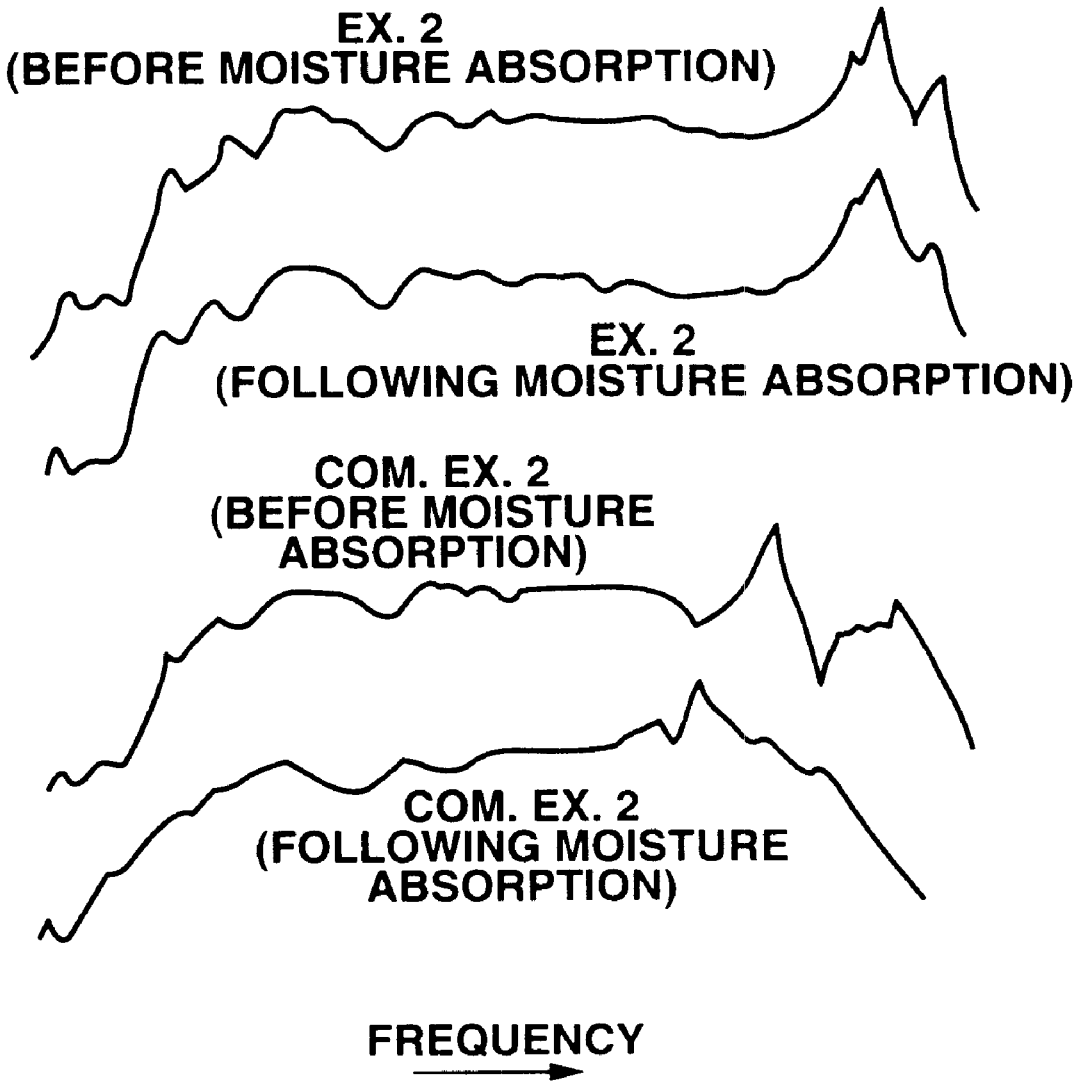
FIG. 2 is a graph showing playback frequency characteristics before and after moisture absorption of a loudspeaker employing a sheet of a glass/polyamide compound material prepared by a paper-making technique and a loudspeaker employing a sheet of a polyamide component prepared by the paper-making technique.

The results are shown in FIG. 2.

As may be seen from FIG. 2, changes in the frequency response are significant before and after moisture absorption in the Comparative Example 2. Conversely, only small changes occur in the frequency response before and after moisture absorption in the Example 2, thus testifying to appreciably improved moisture-proof property.

Investigations into Preparing a Sheet from a Mixed Material by the Paper-Making Technique A mixed material of the glass/polyamide compound material 2 and the pulp was formed into a sheet by a paper-making technique to check for the possibility of preparing a sheet from a mixed material with other materials routinely used in the paper-making technique.

Three mixed liquid dispersions with pulp amounts of 5 weight %, 50 weight % and 95 weight % were prepared to check for the state of liquid dispersion and the state of the sheets formed.

It was found that, in none of the mixed liquids, the tendency for separation was observed. Similarly, in none of the sheets formed, the separated state was observed.

From this it is seen that the sheets can be formed by the paper-making technique from the material composed of a mixture with other materials routinely used in the conventional paper making technique.

What is claimed is:

1. A loudspeaker diaphragm comprising an operatively formed sheet-like member made of a compound material comprising glass particles having a particle size of 8 nm to 300 nm and a polyamide resin.

2. A loudspeaker diaphragm according to claim 1, wherein the content of said glass particles in said compound material is 5 weight % to 7 weight %.

3. The loudspeaker diaphragm according to claim 1, wherein said sheet-like member is formed by the paper-making technique from a mixture of said compound material with an other fiber material.

4. The loudspeaker diaphragm according to claim 3, wherein said other fiber material is pulp.

5. The loudspeaker diaphragm according to claim 3, wherein the proportion of said compound material in the sheet-like member formed by the paper-making technique is 5 weight %.

6. The loudspeaker diaphragm according to claim 1, wherein said compound material is fibrous.

7. A loudspeaker comprising a diaphragm comprising a sheet-like member operatively formed into a cone, the sheet-like member being made of a compound material K comprising a polyamide resin and glass particles having a particle size of 8 nm to 300, the diaphragm being sufficiently thermally stable for inputs of 40 to 80 watts for a period of 100 hours using EIJA testing standards.

8. A loudspeaker comprising a diaphragm comprising a sheet-like member operatively formed into a cone, the sheet-like member being made of a compound material comprising a polyamide resin and glass particles having a particle size of 8 nm to 300, the loudspeaker exhibiting substantially the same frequency response characteristics when prior to and after storage in an atmosphere having a temperature of 25 degrees Celsius and 95 percent humidity.

* * * * *